United States Patent [19]

Goin

[11] Patent Number: 5,076,162

[45] Date of Patent: Dec. 31, 1991

[54] EXPANDABLE MESH FRAME

[76] Inventor: Bobby G. Goin, 1752 Old Niles Ferry Pike, Maryville, Tenn. 37801

[21] Appl. No.: 592,828

[22] Filed: Oct. 4, 1990

[51] Int. Cl.[5] ..... B41F 15/34

[52] U.S. Cl. ..... 101/127.1; 160/374.1; 160/378; 160/381; 38/102.8

[58] Field of Search ..... 101/127.1, 128, 128.1; 160/369, 371, 374.1, 378, 381; 38/102.5, 102.8

[56] References Cited

U.S. PATENT DOCUMENTS

| | | | |
|---|---|---|---|
| 3,211,089 | 10/1965 | Messerschmitt | 101/415.1 |
| 3,230,872 | 1/1966 | De Groot | 101/127.1 |
| 3,409,133 | 11/1968 | Malfroy | 101/415.1 |
| 3,477,574 | 11/1969 | Malfroy | 101/127.1 |
| 3,482,343 | 12/1969 | Hamu | 101/127.1 |
| 3,485,165 | 12/1969 | Hughes | 101/127.1 |
| 3,625,274 | 12/1971 | Johnson | 160/374.1 |
| 3,908,293 | 9/1975 | Newman | 101/127.1 |
| 4,144,660 | 3/1979 | Lamb | 38/102.5 |
| 4,409,749 | 10/1983 | Hamu | 160/378 |
| 4,452,138 | 6/1984 | Bubley et al. | 101/127.1 |

*Primary Examiner*—Edgar S. Burr
*Assistant Examiner*—Stephen R. Funk
*Attorney, Agent, or Firm*—Luedeka, Hodges, Neely & Graham

[57] ABSTRACT

An expandable mesh frame is disclosed for stretching and holding a mesh fabric. The frame consists of four frame rails held together by four corner pieces. The corner pieces fit within the ends of the frame rails to construct the frame and in action with the frame rails provide a selective locking mechanism. When the frame rails are rotated in one direction, as when a fabric mesh is in place on the frame and tension is applied to the mesh, the corner pieces and the frame rail are in an alignment that allows for zero tolerance locking; however, when the frame rails are rotated in the oppposite direction, as when the frame is being disassembled, there is an excess of tolerance between the frame rail and corner pieces. The selective locking mechanism allows for a frame that is easily assembled and disassembled because of the excess tolerance when the frame is in the slack position. However, when the frame is in the locked position, as when a fabric mesh is in place, the existence of zero tolerance between the corner piece and frame rail provides for a rigid dimensionally stable frame which will hold the fabric mesh securely. In addition to ease of assembly and disassembly, the frame is designed to fit current silk screen presses. Additionally, adjustment of the frame is possible while the frame is in place in the press which allows for ease of re-tensioning without removing the frame from the press.

7 Claims, 3 Drawing Sheets

EXPANDABLE MESH FRAME

FIELD OF THE INVENTION

This invention relates to the field of frames designed to hold and stretch pieces of mesh fabric and more specifically the invention provides an adjustable frame for holding, tensioning, re-tensioning, and positioning a silk screen used in a silk screen printing process.

BACKGROUND OF THE INVENTION

To promote efficiency and productivity in a silk screening process, a need exists for a silk screen frame that is easily assembled, tensioned, re-tensioned and disassembled. Prior art devices have usually attempted to conform to one or more of the above criteria, but have, in the process, become less desirable in other criteria. For example, Messerschmitt, U.S. Pat. No. 3,211,089, attempts to provide a frame and screen which will assure even tension across the surface of the screen. However, in so doing, the frame is complex and is not easily assembled and disassembled and the screen requires separate preparation to affix a plastic border. Similarly, deGroot, U.S. Pat. No. 3,230,872, discloses a method which focuses on securing the screen within a groove and on tensioning the screen at the expense of complexity; which makes assembly, disassembly and re-tensioning more difficult and time consuming.

Hughes, U.S. Pat. No. 3,485,165, provides a silk screen frame which allows for uniformity in tensioning a screen and rigidity to retain the proper tension, but it does so using a complex mechanical adjustment system. Lamb, U.S. Pat. No. 4,144,660, is likewise concerned with adjustability which would aid in tensioning and re-tensioning, but again, it adds complexity to the design resulting in the need for special tools and making assembly and disassembly difficult.

Attempts to simplify frame construction which would aid assembly and disassembly have, in prior art devices, resulted in subsequent losses in the ease of tensioning and re-tensioning For example, Johnson, U.S. Pat. No. 3,625,274, is a less complex frame than the previously discussed prior art devices, but makes adjustment in one dimension impossible because the entire corner is expanded with one adjustment screw. Also the frame fit together with a "tight frictional fit" which only complicates assembly and disassembly. The greatest level of simplicity is engendered by Bubley, U.S. Pat. No. 4,452,138. This device uses friction and a bonding agent to make the frame rigid. Assembly is simple; however, the presence of the bonding agent makes re-tensioning and disassembly impossible once a bond has set.

The present device provides a mesh frame which meets the previously listed criteria without unnecessary complexity. The present device, has a selective locking mechanism which provides excess tolerance between the frame rails and corner-pieces so that assembly and disassembly are easy. Once a screen is in place, however, the frame rails are rotated by the tension placed on them by the mesh and engage the selective locking mechanism. As tension is increased by eight independent adjustments, the lock becomes more solid and the tolerance between the frame rail and corner piece is reduced to zero.

With eight independent adjustments the present device allows for proper uniform tensioning of the screen and the placement of the adjustment screws allows re-tensioning of the screen without removal from a silk screen press.

The same excess tolerance that makes assembly easy is reintroduced to the frame by removing the tension from the screen. Once the tension is removed the frame rails may be rotated away from the locked position and there is once again excess tolerance in the frame which allows for the breaking of dried ink "welds" and ease of disassembly.

In this way, the present device overcomes the limitations of the prior art devices which makes for a more productive and efficient silk screen frame.

SUMMARY OF INVENTION

In a preferred embodiment of the present invention an adjustable mesh frame is constructed of four hollow, rectangular cross-section frame rails and four corner pieces which connect the frame rails. Inside each end of each frame rail, at an appropriate distance from the end, is a stop upon which an adjustment screw acts to expand the frame.

The corner-piece consists of two identical arms which are positioned at an angle of 90° with respect to each other. The corner cross-piece is rectangular in cross-section and is solid. Its cross-section is significantly smaller than that of a frame rail so that it will fit inside a frame rail and have a large tolerance. On the corner-piece are projections which, when the frame rails are rotated toward the projections, provide zero-tolerance between the frame and the projections However, when the frame rail is rotated away from the projections there is a high degree of tolerance or play between the rails and corner pieces. Holes are drilled through the centers of the arms of the corner-piece and a threaded insert is placed in each hole. The insert is recessed from the outside end of the corner. Adjustment screws are then placed into the threaded inserts and extend beyond the corner-piece to act upon a stop inside the frame rail.

Once the frame is put together it is very "slack" and a piece of mesh fabric is attached to the frame. By turning the adjustment screws the frame is expanded in all directions and the mesh fabric is tensioned. As it is tensioned the fabric tends to rotate the frame rails towards the projections on the corner-pieces so that the fit between the corner-pieces and the frame rail approach "zero-tolerance". Once the mesh is appropriately tensioned the frame is rigid and the "slack" is eliminated by the interaction between the frame rail and the corner piece projections.

When use is completed, the adjustment screws are loosened and the mesh is removed. The frame rails may then be rotated away from the corner piece extensions and "slack" will again be present in the frame, allowing ease of disassembly.

A frame which is quickly assembled, tensioned, re-tensioned, and disassembled will add to increased productivity and efficiency. Quick assembly and tensioning requires that there be sufficient tolerance between the frame rails and corner-pieces so that the corner-pieces may be easily inserted and that they will not bind when a "see-saw" effect is present; as when one side of the frame is expanded before the other. Ease in re-tensioning requires that the frame not be removed from the press when re-tensioning is required. Ease in disassembly requires that any "weld" which occurs because of the build-up of printing inks and paints in the frame rail during printing be easily broken by sufficient tolerance between the frame-rail and corner-piece.

BRIEF DESCRIPTION OF THE DRAWINGS

Whereas the above describes the field, the problems of prior art silk screen frames, and the general features of the present invention, a preferred embodiment is now described in detail. This description is for illustration and not limitation of the apparatus of the present invention and may best be understood by reference to the Drawings in which.

DETAILED DESCRIPTION OF A PREFERRED EMBODIMENT

Figure 1:
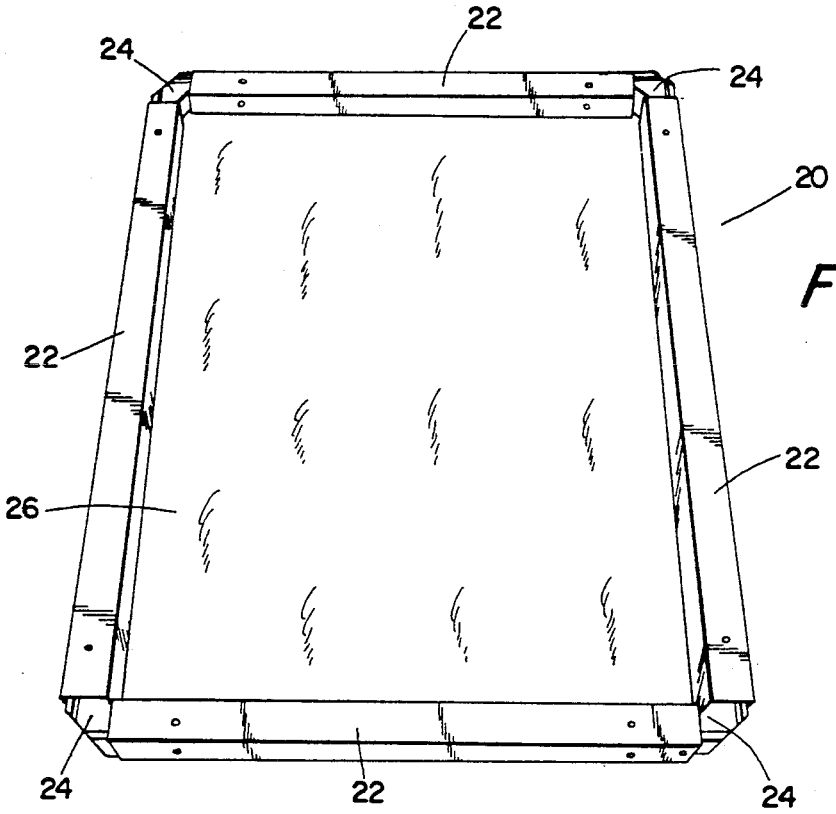
FIG. 1 is a top view of the frame with a fabric mesh in place.

Referring now to the figures in which like reference numerals indicate like or corresponding features there is shown in FIG. 1 an expandable mesh frame 20. The frame 20, which is made up of four frame rails 22 connected by four corner pieces 24, supports and tensions a fabric mesh 26, which is attached to stretched across the bottom of the frame 20. The frame rails 22 are constructed of hollow tubular metal, preferably aluminum, which has a substantially rectangular cross-section. Although a rectangular cross section is preferred, it will be understood that other cross sectional shapes for frame rails 22 and arms 40 may be used. The corner pieces 24 have arms 40 (See FIG. 6) which are likewise substantially rectangular in cross-section and fit within the hollow frame rails 22. Hence, the frame 20 is assembled by connecting the frame rails 22 with the corner pieces 24 which then may support a fabric mesh 26 that is glued or taped or otherwise attached to the frame rails 22.

Figure 2:
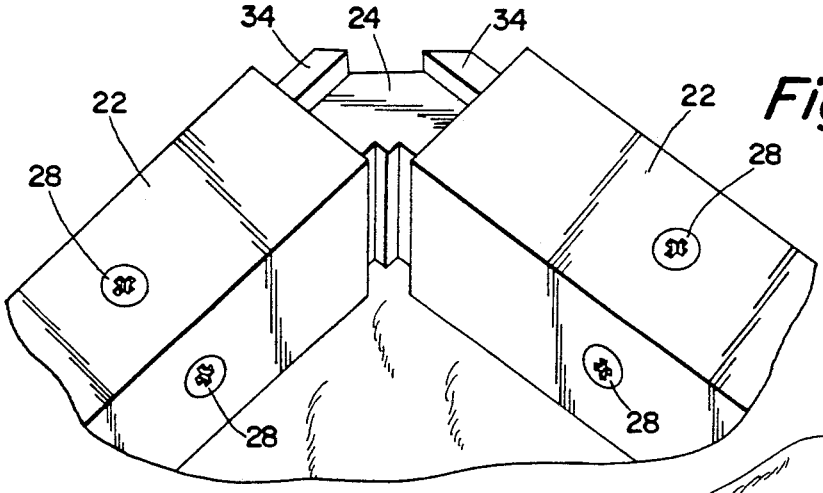
FIG. 2 is a top interior view of one corner of the frame.
Figure 3:
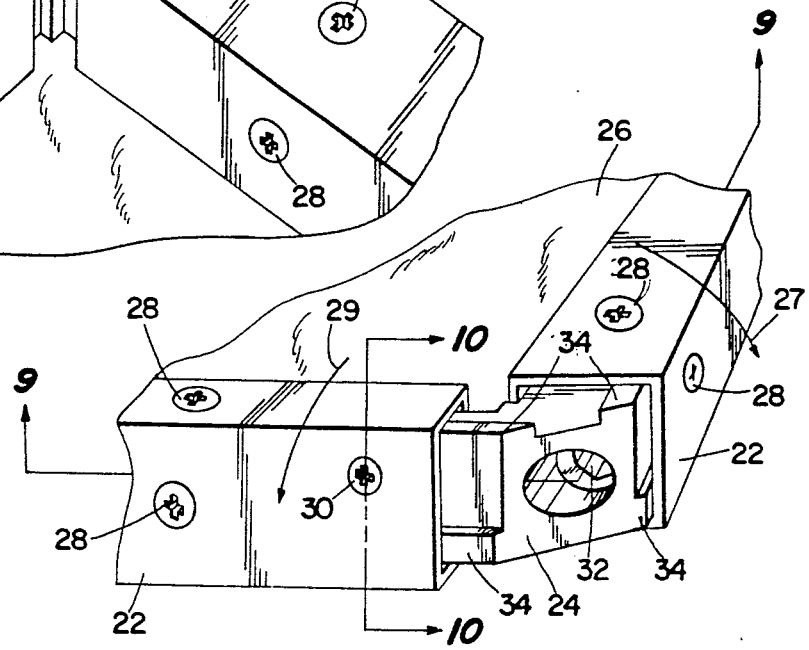
FIG. 3 is a top exterior view of one corner of the frame with a mesh attached.

FIGS. 2 and 3 give a more detailed view of one corner piece 24 connecting two frame rails 22. From these views, projections 34 are evident on the corner pieces 24. It is these projections 34 in concert with the rotational force (indicated by arrows 27 and 29 in FIG. 3) imparted to the frame rails 22 by the tensioned fabric mesh 26 that provides the selective locking mechanism discussed in the summary.

Figure 6:
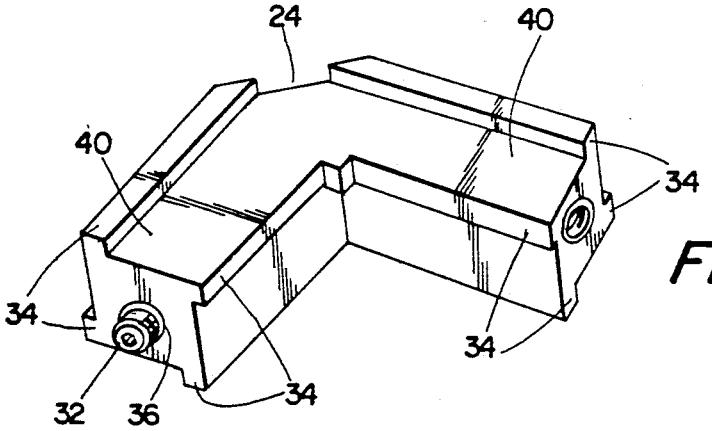
FIG. 6 is a top interior view of a corner piece showing the threaded insert and adjustment screw.
Figure 7:
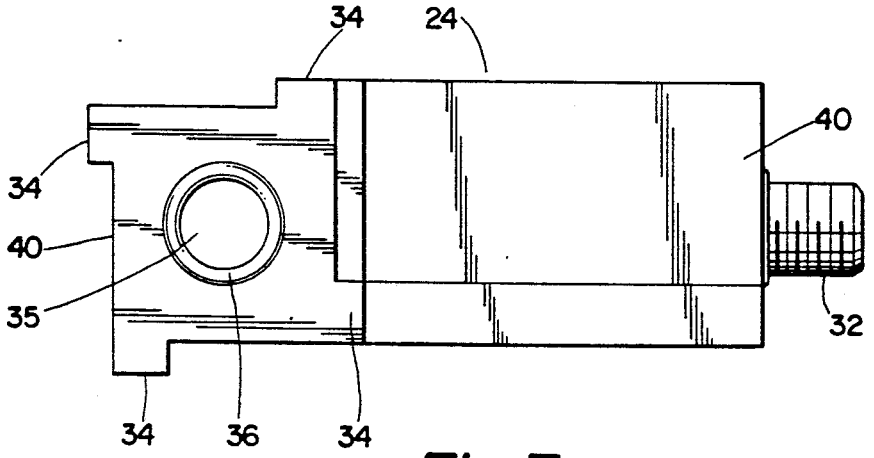
FIG. 7 is a side view of a corner-piece showing the projections and threaded insert.

The construction of the corner-piece 24 may be best understood with reference to FIGS. 6 and 7. A single corner-piece 24 is shown in FIGS. 6 and 7 in which the overall design and features of the corner-piece 24 may be seen. The corner-piece 24 is an L-shaped member having two arms 40 oriented at an angle of approximately 90° to each other. The arms 40 have a substantially rectangular cross-section with projections 34 extending along the edges thereon.

A passageway 35 is formed through the length of each arm 40 within which is secured a threaded insert 36 which forms a threaded passageway. An adjustment screw 32 may then be threaded into the insert 36. The passageway 35 is preferably drilled in such a manner as to allow the head of the adjustment screw 32 to be recessed within the corner piece 24; also, the adjustment screw 32 is preferably sized to allow its end to extend beyond the end of the arm 40 of the corner piece 24.

Figure 8:
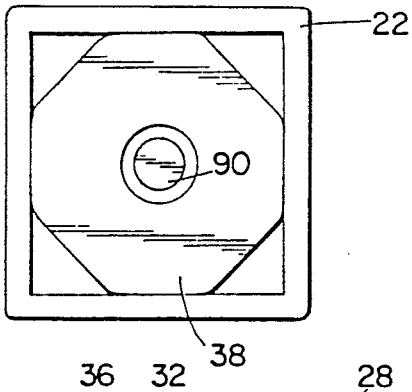
FIG. 8 is an end view of one frame rail showing a stop.

FIG. 8 shows the end and interior of a frame rail 22. Visible is a stop 38, having a depression 90 into which the end of an adjustment screw 32 may seat, secured by screws 28 (visible in FIGS. 2 and 3). By acting against the stop 38 an adjustment screw 32 may be used to expand the frame in a linear dimension; the depression 40 aids in the proper alignment of the corner piece 24 and the frame rail 22.

In use, a fabric mesh 26 is securely attached by some means, such as gluing, to the frame rails 22 with the corner pieces 24 in place in the frame 20 of FIG. 1. The adjustment screw 32 is rotated and acts against the stop 38 (See FIG. 9) secured within the frame rail 22 by stop screws 28. The action of the adjustment screw 32 against the stop causes the frame 20 to expand and tension the fabric mesh 26. As the mesh 26 is tensioned a rotational force (indicated by the arrows 27 and 29 in FIG. 3) is placed upon the frame rail 22. The rotational force makes the frame rail 22 rotate in the direction of the arrows which eliminates the tolerance between the projections 34 on the corner piece 24 and the inside of the frame rail 22. As the tension on the mesh increases, the frame rail 22 abuts the projections 34 and locks the frame rails 22 onto the corner pieces 24. This close tolerance results in a stiffening of the frame 20 when a piece of fabric mesh 26 is properly tensioned on it.

Figure 9:
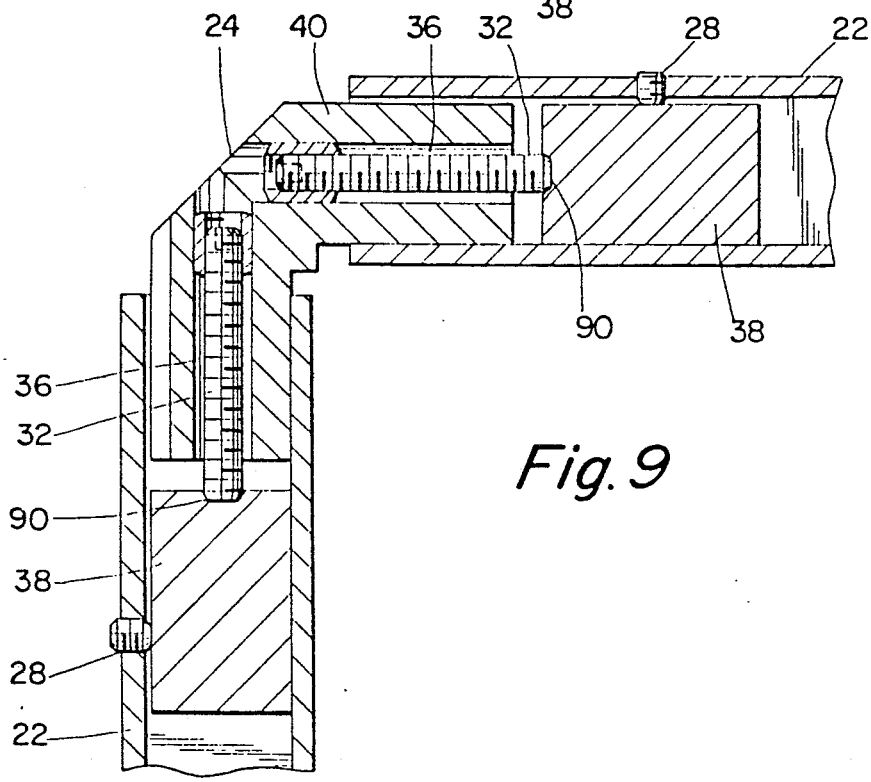
FIG. 9 is a cross-sectional view of one corner-piece taken through lines 9—9 as indicated in FIG. 3.
Figure 10:
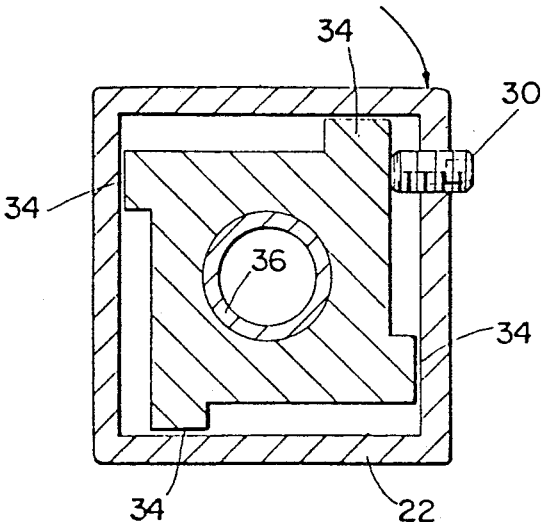
FIG. 10 is a cross-sectional view showing the relationship between the frame rail and the corner piece in the tensioned configuration, which orientation is indicated by lines 10—10 in FIG. 3.
Figure 11:
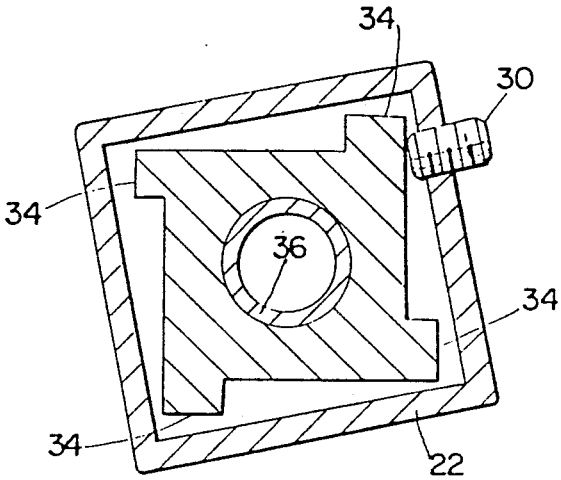
FIG. 11 is a cross-sectional view similar to FIG. 10 showing the relationship between the frame rail and the corner piece in the "slack" configuration.

The tensioning process may be better understood by reference to the cross sectional views, FIGS. 9, 10 and 11, the orientation of which is referenced by the lines and arrows marked 9—9 and 10—10 in FIG. 3. The view of FIG. 9 shows a corner piece 24 in place connecting two frame rails 22. The recessed adjustment screws 32 are in place and the ends are in contact with the stops 38 which are secured to the frame rail 22 by screws 28. As one adjustment screw 32 is rotated in a clockwise direction the effect is to push the corner piece 24 away from the stop 38; in effect this lengthens the linear dimension of the frame rail 22 upon which the rotated screw 32 is acting. This action causes the fabric mesh 26 to be tensioned and increases the rotational force upon the frame rail 22 which is perpendicular to the frame rail acted upon by the rotated screw 32. This procedure is repeated for all eight adjustment screws 32 in the frame 20 of FIG. 1 until an even tension is placed on the fabric mesh 26.

Figure 4:
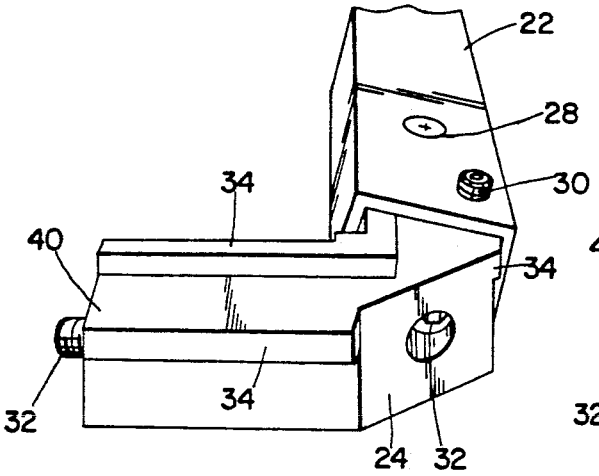
FIG. 4 is a bottom exterior view of a corner-piece with one rail in place in the "slack" orientation.
Figure 5:
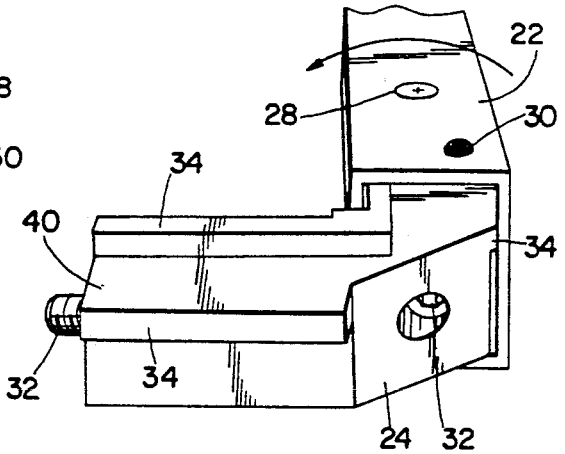
FIG. 5 is a bottom exterior view of corner-piece with one rail in place in the tensioned orientation showing the direction of the rotational force exerted on the frame rail by a tensioned fabric.

Referring now to FIGS. 4, 5, 10, and 11 the unique functioning of the corner design may be described in detail. FIGS. 4 and 5 are bottom side views of one corner piece 24 and with one frame rail 22 in place. In this view a fabric mesh would be stretched across the top of the frame although for the sake of clarity one is not included in these figures. FIG. 4 shows the frame rail 22 in a "slack" orientation with respect to the corner piece 24. This "slack" orientation results from the fact that there is no rotation force tending to rotate the interior of the frame rail 22 towards the projections 34 on the corner piece 24. In this configuration there is an excess of tolerance between the corner piece 24 and the frame rail 22. A cross-sectional view of the relationship between a frame rail 22 and the corner piece 24 in the "slack" orientation is seen in FIG. 11. From this view it is apparent that when the corner piece 24 is in the "slack" orientation it will contact the inner portion of the frame on only two sides of the arm 40 of the corner piece 24. There is space between the frame rail 22 and the edges of the arm 40 which provides the described tolerance. Once a fabric mesh is in place and is being tensioned, frame rails 22 are rotated towards the projections 34 on the arms 40 of the corner piece 24. An example of this action is seen in FIGS. 5 and 10. When the mesh is fully tensioned the edges of the projections 34 are positioned flush against the interior sides of the frame rail 22 providing zero tolerance. In this manner, when the frame rail 22 is rotated away from the projections 34, tolerance between the corner piece 24 and the interior sides of the frame rail is increased. However, when the frame rail 22 is rotated toward the projection 34 on the corner piece 24, as when a mesh is being tensioned, the interior sides of the frame rail 22 will contact the projections 34 and the frame will be locked in a rigid manner. To ensure against warping of the frame, a nylon tipped set screw 30 is tightened against each arm 40 of a corner piece 24. This set screw 30 simply maintains the appropriate alignment of the arm 40 within the frame rail 22 and does not interfere with the re-tensioning process.

It is this variable tolerance that provides this frame with a selective locking mechanism. When the frame 20 is tensioned the rails 22 rotate towards the projections 34 on the arms 40 of the corner piece 24, which creates zero tolerance between the projection 34 and the inside of its frame rail 22 and thereby locks the frame 20. When the tension is removed, the frame rails 22 may be unlocked by backing off the set screws 30 and rotating the frame rails 22 away from the projections 34. In the unlocked (or slack) configuration there is a high degree of tolerance between the arms 40 of the corner piece and the interior of the frame rail 22. In use this locking procedure occurs at all eight arms of the four corner pieces in the assembled frame 20 of FIG. 1.

The degree of tolerance between the frame rail 22 and corner piece 24 before tensioning provides several benefits. First it makes a frame 20 easier to assemble. If the arms 40 of the corner piece 24 were built to provide the same amount of surface contact within the frame rail 22 as provided by the projections 34 without some method for varying tolerance, friction would make assembly difficult if not impossible. Even if assembly were possible with a corner piece that did not allow for variable tolerance, then it would not be possible to achieve the rigidity available when the current frame 20 is tensioned.

Second, the degree of variable tolerance prevents the arm 40 of the corner piece 24 from binding in the frame rail 2 during tensioning. As one side of the frame 20 is expanded during tensioning, the arms 40 of the corner pieces 24 on the opposite side of the frame rail 22 will become canted within the frame rail 22. Without the degree of variable tolerance provided in the current frame 20 this canting would cause a close tolerance corner piece to bind. Due to this feature of the present frame 20, the mesh 26 may be tensioned by one person in a "see-saw" manner with one side being expanded before the other.

A final benefit of the variable tolerance of the present frame, is that welds formed during the printing process between the projections 34 and the interior frame rail 22, due to drying printing inks, may be broken by rotating the frame rail 22 away from the projections 34 and increasing the tolerance. If the corner piece had close tolerance arms there would be no simple way to break any such weld. This feature allows for ease in disassembly of the frame after use.

While the invention has been described in terms of a preferred embodiment, it is to be understood that nothing in the above description is intended to limit the scope of the claims and it is contemplated that numerous changes and modifications can be made without departing from the spirit of the invention.

What is claimed is:

1. A frame for supporting, tensioning and holding a fabric mesh comprising:

a plurality of tubular frame rails each having two ends for supporting the mesh and applying a tension force to the mesh tending to rotate the rails in a first direction;

a plurality of corner pieces each having two arms, said arms telescopically engaging said tubular frame rails for connecting said tubular frame rails end-to-end to form an expandable frame for supporting, tensioning and holding the fabric mesh; and said corner pieces in cooperation with said tubular frame rails further comprising a selective locking mechanism for locking said corner pieces to said frame rails when said frame rails are rotated in response to the tension force in the first direction by increasing the contact between said rails and said arms;

and unlocking said corner pieces from said frame rails in response to reduction or release of the tension force by rotation of the frame rails in a second direction with respect to the arms of the corner pieces to reduce the contact between said frame rails and said arms;

said second direction being generally opposite said first direction.

2. The apparatus of claim 1 wherein said fabric mesh is a silkscreen used in a silkscreen printing process.

3. The apparatus of claim 1 wherein said tubular frame rails have a rectangular interior cross-section.

4. The apparatus of claim 3 wherein each of said corner pieces comprise:

at least two arms of approximately equal length disposed at an angle of approximately 90° to each other, said arms being generally rectangular in cross-section and having a cross-section smaller than the interior cross-section of said frame rails; and projections disposed on the edges of said arms, said projections comprising a portion of said arms which contact said frame rails whereby when a frame rail is rotated toward said projections, as when the tension force is present, there will be substantial contact between said projections and the interior of the frame rail and when the frame rail is rotated away from said projections, as when the tension force is reduced or released contact between the frame rail and said projections is substantially reduced.

5. The apparatus of claim 4 further comprising:

a threaded passageway provided in each of said arms of said corner pieces;

an adjustment screw placed in each of said threaded passageways extending through said passageway and beyond said arm; and at least two stops securedly fastened within each of said tubular frame rails near each of said ends upon which said adjustment screws may act to expand said frame.

6. A frame for supporting and tensioning a fabric mesh comprising:

at least three frame rails to which the fabric mesh may be secured, for supporting and applying tension force to the fabric mesh, the tension force tending to rotate said rails in a first direction, each frame rail having at least two ends;

at least three corner pieces for engaging and holding the ends of said frame rails to form the frame upon which the fabric mesh may be supported and tensioned;

said corner pieces each having two arms configured to mate with the ends of said frame rails and form a telescoping engagement whereby said frame rails may slide axially on said arms for a predetermined distance; and means for selectively locking said frame rails on said arms responsive to rotation of said frame rails resulting from the tension force in the first direction with respect to said arms and for unlocking said frame rails from said arms when said frame rails are rotated by reduction or release of the tension force in the opposite direction with respect to said arms, whereby the frame may be adjusted in size by sliding said frame rails on said arms of said corner pieces and whereby the size of the frame may be fixed by rotating said frame rails and thereby locking them on said corner pieces.

7. A frame system for holding and tensioning a silk screen within a silk screen press comprising:

a plurality of tubular frame rails having a substantially rectangular cross section, each of said rails having two ends, an interior, and a stop secured within each of said rails near each of said ends for supporting and applying a tension force to a silk screen;

a plurality of corner pieces connecting said frame rails, each comprising at least two arms of approximately equal length, said arms being generally rectangular in cross section and having projections edgewise disposed thereon, said cross section of said arms being generally smaller than said cross section of said frame rails, and each of said arms having a threaded passageway extending therethrough containing an adjustment screw extending beyond the ends of said arms;

a silk screen affixed to said frame rails to be tensioned on said frame system and exerting a rotational force on said frame rails when said screen is tensioned;

said adjustment screws in said arms of said corner pieces being adapted and dimensioned for acting against said stops in said frame rails to telescopically expand said frame system and thereby tension said silk screen; and said projections on said arms and the interior of said frame rails being adapted and dimensioned to engage and lock said frame rails to said arms of said corner pieces when said silk screen exerts the rotational force on said frame rails while being tensioned, thereby rotating said frame rails toward said projections.

* * * * *